US009768550B2

(12) United States Patent
Goletto et al.

(10) Patent No.: US 9,768,550 B2
(45) Date of Patent: Sep. 19, 2017

(54) CONNECTOR HAVING A SLIDE WITH MEANS TO RESTRAIN A CABLE GUIDE COVER TO A HOUSING

(71) Applicant: Delphi International Operations Luxembourg S.A.R.L., Bascharage (LU)

(72) Inventors: Olivier Goletto, Bois d'Arcy (FR); Gaurav Bhutani, Conflans St. Honorine (FR)

(73) Assignee: DELPHI INTERNATIONAL OPERATIONS LUXEMBOURG S.A.R.L., Luxembourg (LU)

( * ) Notice: Subject to any disclaimer, the term of this patent is extended or adjusted under 35 U.S.C. 154(b) by 0 days.

(21) Appl. No.: 15/344,652

(22) Filed: Nov. 7, 2016

(65) Prior Publication Data

US 2017/0149174 A1 May 25, 2017

(30) Foreign Application Priority Data

Nov. 20, 2015 (FR) ..... 15 61197

(51) Int. Cl.
*H01R 13/62* (2006.01)
*H01R 13/629* (2006.01)

(52) U.S. Cl.
CPC . *H01R 13/62977* (2013.01); *H01R 13/62933* (2013.01); *H01R 13/62938* (2013.01)

(58) Field of Classification Search
CPC ..... H01R 13/4362; H01R 13/4365; H01R 13/62933; H01R 13/62938; H01R 13/62944; H01R 13/62955; H01R 13/62977; H01R 13/62988
USPC ..... 439/157, 331, 372, 595, 752, 160
See application file for complete search history.

(56) References Cited

U.S. PATENT DOCUMENTS 5,681,175 A * 10/1997 Busse ..... H01R 13/62977 439/157
6,213,795 B1 * 4/2001 Drescher ..... H01R 13/62977 439/152
7,223,130 B2 * 5/2007 Osada ..... H01R 13/4362 439/157
7,435,113 B2 * 10/2008 Cheng ..... H01R 13/6295 439/157
7,837,485 B2 11/2010 Epe et al.
7,959,452 B2 * 6/2011 Komiyama ..... H01R 13/62944 439/157
8,057,245 B2 * 11/2011 Sakamaki ..... H01R 13/62933 439/157

(Continued)

FOREIGN PATENT DOCUMENTS

DE 8700210 U1 8/1987
DE 102006058680 A1 6/2008

(Continued)

*Primary Examiner* — Chandrika Prasad
(74) *Attorney, Agent, or Firm* — Robert J. Myers

(57) ABSTRACT

The invention relates to a lever-type connector for facilitating the connection. The connector includes a housing on which a cable guide cover is mounted. A lever is rotatably mounted on the cable guide cover and displaces a slide. In the course of the rotation of the lever, the slide cooperates with the cable guide cover in order to maintain the cable guide cover on the housing with greater force and in a better-adapted manner.

9 Claims, 2 Drawing Sheets

(56) References Cited

U.S. PATENT DOCUMENTS

| | | | | |
|---|---|---|---|---|
| 8,246,365 | B2 * | 8/2012 | Shishikura ..... | H01R 13/62944 439/157 |
| 8,968,038 | B2 * | 3/2015 | Kida ..... | H01R 12/7023 439/374 |
| 9,048,579 | B2 | 6/2015 | Itou et al. | |
| 9,276,345 | B2 * | 3/2016 | Guillanton ..... | H01R 13/4226 |

FOREIGN PATENT DOCUMENTS

| | | | |
|---|---|---|---|
| DE | 102011101205 | A1 | 2/2012 |
| FR | 2853459 | A1 | 10/2004 |
| WO | 02078126 | A2 | 10/2002 |

* cited by examiner

CONNECTOR HAVING A SLIDE WITH MEANS TO RESTRAIN A CABLE GUIDE COVER TO A HOUSING

CROSS-REFERENCE TO RELATED APPLICATION

This application claims the benefit under 35 U.S.C. §119 (a) of Patent Application No. 1561197 filed in the Institut National de la Propriété Industrielle (French Patent Office) on Nov. 20, 2015, the entire disclosure of which is hereby incorporated by reference.

TECHNICAL FIELD OF THE INVENTION

The invention relates to the field of connector technology, and in particular that of automotive connector technology.

BACKGROUND OF THE INVENTION

Connectors are used to transmit signals or electrical energy between cables, devices (computer, lighting, etc.), or motors. In particular, electrical connectors include electrical contacts in a greater or smaller number or of a larger or smaller size. The contact force must be sufficiently high in order to ensure good electrical conduction between male and female contacts. For this reason, and in particular if contacts are of relatively large size, for example as a result of being connected to a source of an electrical power supply the insertion force of the male contact into the female contact may become relatively large.

In order to limit and, if possible, to avoid the risks of musculoskeletal disorders for the operators responsible for the fitting and the connection of the connectors certain connectors are equipped with a device for facilitating the connection or for assisting with the coupling of a connector to a counter-connector. Such a device for facilitating the connection may include a sliding drawer, or slide, and a rotating lever, for example. In this case, and in a manner known per se, a system of gearing having teeth on a part of the lever which is caused to rotate when the lever is actuated, as well as a rack on the slide, makes it possible to displace the slide in translation. In the course of the translation, a ramp device on the slide and a pinion device on the counter-connector makes it possible to drive the counter-connector in order to couple it to the connector.

In addition, the connector may be equipped with a cable guide cover in order to guide and maintain the cables that are electrically connected to the contacts fitted in the connector. In this case, the lever may be rotatably mounted on the cable guide cover. However, it is possible for the teeth of the lever to deviate too far from the rack of the slide which may give rise to blockages or malfunctioning of the assembly of the device for facilitating the connection. It is also possible for the cable guide cover to become detached from the housing.

A solution is proposed in document U.S. Pat. No. 9,048,579 B2 according to which the cable guide cover and the housing are maintained together by a system of grooves and ribs disposed longitudinally to either side of the portion of the housing in the area of which the lever cooperates with the slide. Whereas this solution may possibly enhance the maintenance of the cable guide cover on the housing, it does not necessarily completely address the problem of the lack of interaction between the teeth of the lever and the rack of the slide. Blocking of the device for facilitating the connection may still occur, therefore. In addition, this solution makes it necessary to position this portion in a relatively central manner on the housing and, for this reason, limits the potentially useful length of the lever for a given size of the connector and its lever and consequently increases the force to be applied to the lever in order to couple the connector to the counter-connector.

The subject matter discussed in the background section should not be assumed to be prior art merely as a result of its mention in the background section. Similarly, a problem mentioned in the background section or associated with the subject matter of the background section should not be assumed to have been previously recognized in the prior art. The subject matter in the background section merely represents different approaches, which in and of themselves may also be inventions.

BRIEF SUMMARY OF THE INVENTION

A connector including a housing, a lever for facilitating the connection, a slide for facilitating the connection and a cable guide cover are presented. The lever is rotatably mounted on the cable guide cover about an axis of rotation. The rotation of the lever thus takes place essentially between a pre-coupling position, in which a counter-connector may be coupled to the connector, and a locking position, in which the connector and the counter-connector are locked together. The slide is movably mounted on the housing. It is driven via the lever in translation in a direction that is essentially perpendicular to the axis of rotation of the lever. The translation takes place essentially between an initial position, corresponding to the pre-coupling position of the lever, and a final position, corresponding to the locking position of the lever. In the course of its translation, the slide cooperates with the counter-connector in order to couple the counter-connector to the connector.

In addition, the slide includes means for restraining the cable guide cover, which means are displaced together with the slide and move into engagement with the cable guide cover in the course of rotation of the lever.

The chain of the dimensions and of the tolerances between the teeth of the lever and the rack of the slide is reduced in this way because, according to the invention, a direct interaction exists between the cable guide cover and the slide in its final position, but without passing via the intermediary of the housing. The risk of failure in the interaction between the teeth of the lever and the rack of the slide and of blockage of the device for assisting with the coupling which may result therefrom is then reduced.

This arrangement likewise makes it possible to make the cable guide cover non-removable if the lever is in the locking position. In fact, it is first necessary for the slide to release the cable guide cover (although the lever should not be in the locking position) in order to disassemble it from the housing. It is thus no longer possible to lose the cable guide cover or to disassemble it inadvertently in the event of incorrect operation.

The connector may in addition include one or more of the following features considered in isolation or in combination with one or more others:

- the cable guide cover includes a front portion and a rear portion, the front portion being provided with a fixing foot that is disengaged from the means for restraining the slide when the slide is in the initial position and cooperating with the means for restraining the slide when the slide is in the final position, and the rear portion being provided with a means for anchoring the cable guide cover on the housing;

the cable guide cover includes an opening situated in the rear portion for the passage of at least one cable that is electrically connected to a contact mounted in the housing;

the means for anchoring are caused to engage with the housing in the course of positioning the cable guide cover on the housing by raising the front portion in relation to the housing before returning the front portion towards the housing and placing the fixing foot in a zone of the housing that is covered by the slide when the latter is in the final position;

the lever includes teeth for driving the slide coming into engagement with a rack of the slide when the front portion of the cable guide cover is returned towards the housing and when the slide is in the initial position;

the teeth for driving the slide interact with the rack of the slide in the area of a portion of the connector situated towards the rear portion in relation to the fixing foot;

the fixing foot includes a ramp cooperating with the slide and drawing the cable guide cover towards the housing when the slide is in the final position;

the means for restraining the cable guide cover include a rib that is integrally formed with the slide and is engaged in a groove of the cable guide cover when the slide is in the final position.

According to another aspect, the invention relates to a connection assembly including a connector according to one of the preceding claims and a counter-connector in which:

the counter-connector may be coupled to the connector when the lever is in the pre-coupling position;

the connector and the counter-connector are locked together in the locking position; and the slide cooperates with the counter-connector in the course of its translation between its initial position and its final position in order to couple the counter-connector to the connector and contributes, in the final position, to the maintenance of the cable guide cover on the housing.

BRIEF DESCRIPTION OF THE SEVERAL VIEWS OF THE DRAWING

The present invention will now be described, by way of example with reference to the accompanying drawings, in which.

In the various figures, similar or identical elements bear the same references.

DETAILED DESCRIPTION OF THE INVENTION

Figure 1:
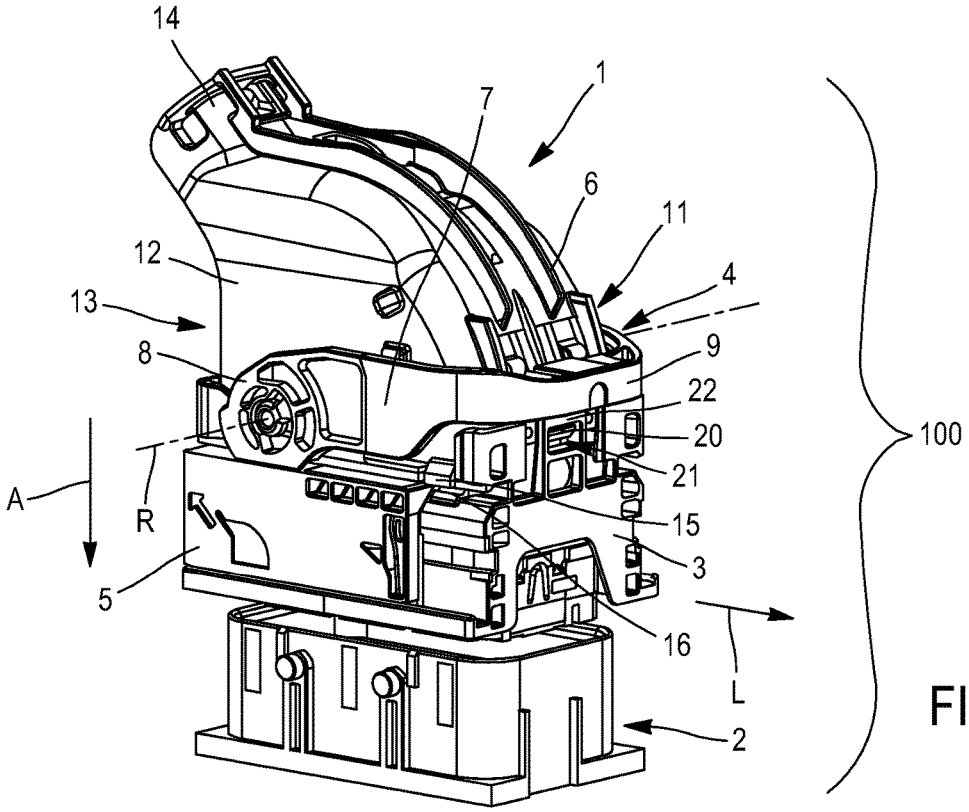
FIG. 1 schematically depicts in perspective a connection assembly including a connector and a counter-connector, wherein these are not yet coupled together.

A non-limiting example of a connector assembly 100 is depicted in FIG. 1. The connector assembly 100 includes a connector 1 and a counter-connector 2. In this figure, the connector 1 and the counter-connector 2 are positioned with their coupling faces facing one another although the connector 1 and the counter-connector 2 are not coupled together. In order to be coupled and connected, the connector 1 and the counter-connector 2 must be displaced one towards the other in a direction of coupling A shown vertically in the figures and the counter-connector 2 must then be engaged, at least in part, in the connector 1 by causing them to continue to be displaced in the direction of coupling A.

The connector 1 includes in particular a housing 3, a lever 4 for facilitating the connection, two slides 5 likewise making a contribution to facilitating the connection and a cable guide cover 6. The housing 3, the lever 4 for facilitating the connection, the two slides 5 and the cable guide cover 6 are molded in a plastic material.

The connector 1 likewise includes, albeit not illustrated here, female contacts or clips that are constituted by a metallic conductor. Similarly, the counter-connector 2 includes male contacts or tongues (not depicted in the figures) that are constituted by a metallic conductor.

Figure 2:
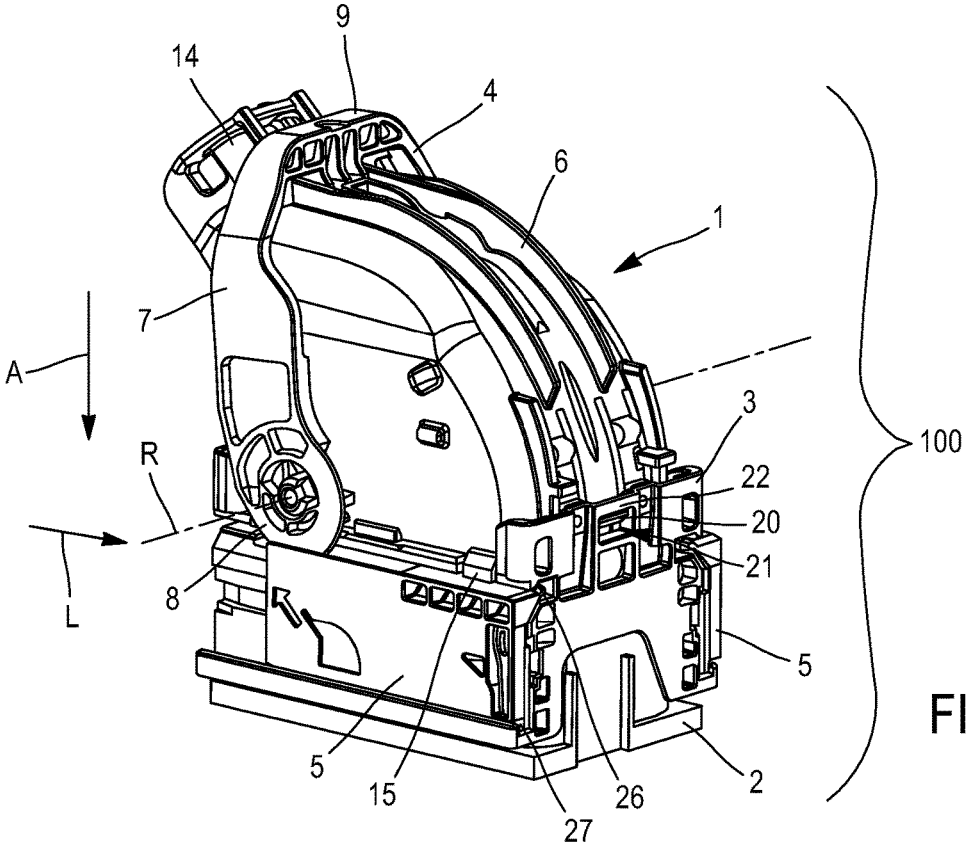
FIG. 2 schematically depicts in perspective the connection assembly depicted in FIG. 1, wherein these are coupled together.

As may be appreciated in FIGS. 1 and 2, the lever 4 is rotatably mounted on the cable guide cover 6 about an axis of rotation R perpendicular to the direction of coupling A. The slides 5 are mounted in translation in a longitudinal direction L simultaneously perpendicular to the directions of coupling A and rotation R on the longitudinal flanks in the form of two branches 7 of the lever 4.

In FIG. 1, the lever 4 is in the pre-coupling position in order to permit the coupling of the connector 1 to the counter-connector 2 and the slides 5 are in the initial position.

In FIG. 2, the connector assembly 100 is depicted with the connector 1 and the counter-connector 2 coupled, that is to say attached mechanically to one another and connected electrically. When coupled to the counter-connector 2 in this way, the connector 1 has its lever 4 in the locked position and the slides 5 are in the final position.

The lever 4 exhibits a generally "U"-shaped form with two branches 7, each respectively constituting a lever arm. One extremity of each of the branches is articulated on one face of the cable guide cover 6 via the intermediary of an articulation portion 8, whereas the other two extremities are connected via a handle 9.

The cable guide cover 6 is defined as having a front portion 11 that is opposite, relative to the longitudinal direction L, to a rear portion 12 provided with an opening 13 for the passage of cables (not depicted in the figures) that are electrically connected to the contacts fitted in the housing 3. The cables exiting via the opening 13 may be attached with one or a plurality of cable ties to a collar 14. Consequently, a considerable pulling force may possibly be applied to the rear portion 12 of the cable guide cover 6, which pulling force could cause the cable guide cover 6, in particular at the level of its front portion 11 to become disassociated from the housing 3. It is advantageous therefore to dispose robust and effective means in order to maintain the cable guide cover 6 on the housing 3 and, indirectly, the lever 4 in engagement with the slides 5 as described below in a more detailed manner.

The cable guide cover 6 includes fixing feet 15 that are integrally formed with the cable guide cover 6. The fixing feet 15 extend respectively in the direction of coupling A from an edge of the cable guide cover 6 parallel to the longitudinal direction L. The fixing feet 15 are situated in the area of the front portion 11 of the cable guide cover 6. The fixing feet 15 include a groove 16 that is open towards the exterior of the connector 1 and extend longitudinally parallel to the longitudinal direction L when the cable guide cover 6 is fixed to the housing 3.

Figure 3A:
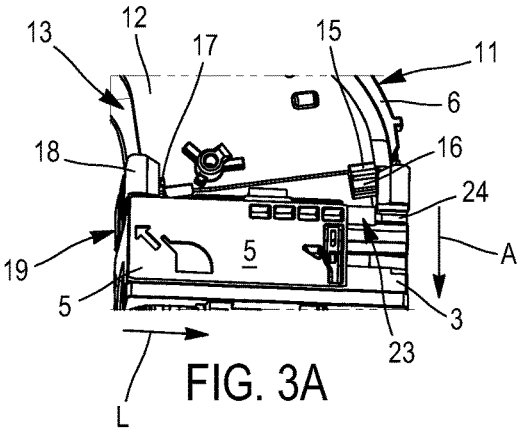
FIGS. 3A and 3B schematically depict in perspective the connector depicted in FIGS. 1 and 2 respectively with the cable guide cover in a position in which it is engaged with the housing only via its rear portion and the same connector in the pre-coupling position with the cable guide cover engaged with the housing likewise via its front portion but with the slides in the initial position and not yet cooperating with the cable guide cover.

As depicted in FIG. 3A, the cable guide cover 6 includes means for anchoring 17 situated in the area of the rear portion 12 in proximity to the opening 13 (in FIG. 3A, the lever 4 not being depicted for greater clarity although it is normally present in the course of this phase of assembling the connector 1). The means for anchoring 17 are present, for example in the form of a beam that is integrally formed with the rest of the cable guide cover 6. The beam is engaged in a throat provided in the edge 18 extending the rear face 19 of the housing 3. For this purpose, the front portion 11 of the cable guide cover 6 is raised in relation to the housing 3 in such a way as to permit the articulation portions 8 of the lever 4 to be inserted into a slot provided on the top of the slides 5 (see FIG. 3B).

Figure 3B:
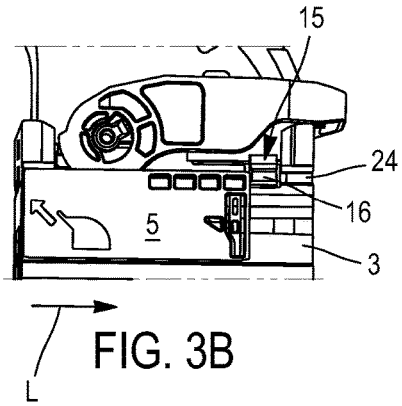

Subsequently, as depicted in FIG. 3B, the front portion 11 of the cable guide cover 6 is lowered onto the housing 3. The cable guide cover 6 is maintained in this position with the help of a hook 20 engaging in a notch 21 produced on a foot 22 that is integrally formed with the housing 3 (see FIGS. 1 and 2). In the course of this operation, the fixing feet 15 are each brought respectively into a recess 23 provided in the housing 3 (see FIG. 3A). The fixing feet 15 are then present in a zone of the housing 3 that is covered by the slide 5 when the latter is in the final position (see FIGS. 4B and 4C, for example). In this position, the respective grooves 16 of the fixing feet 15 are essentially present in the extension of a similar groove 24 provided on each of the longitudinal lateral faces of the housing 3 in proximity to an upper edge of the latter. As depicted in particular in FIG. 4A, another groove 25, parallel to the preceding groove 24, is likewise provided on each of the lateral longitudinal faces of the housing 3 in proximity to a lower edge of the latter.

Each slide 5 is present in the form of a plate having means for restraining the cable guide cover 6. For example, the means for restraining the cable guide cover 6 include an upper rib 26 parallel to the longitudinal direction L. Each slide 5 may likewise include a lower rib 27 that is likewise parallel to the longitudinal direction L. The lower ribs 27 and the upper ribs 26 are molded together with each slide 5. Each slide 5 is then mounted on a longitudinal lateral face of the housing 3 with its lower ribs 27 and its upper ribs 26 each engaged respectively in a groove 24, 25 provided in a longitudinal lateral face of the housing 3. The grooves 24 and 25 extend to either side of the recesses 23 for the fixing feet 15, each slide being maintained accurately and in a robust manner for the major part of their length on the housing 3.

Figure 4A:
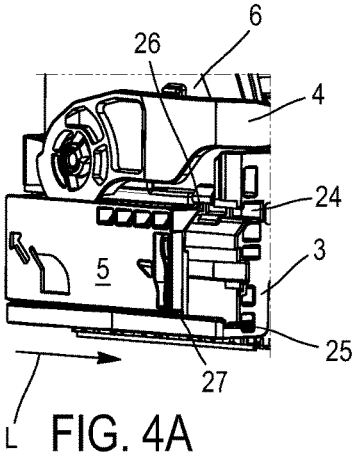
FIGS. 4A to 4C schematically depict in perspective the connector depicted in FIGS. 1, 2, 3A, and 3B, with the slides respectively in the initial position corresponding to FIG. 3B in an intermediate position and in their final position.
Figure 4B:
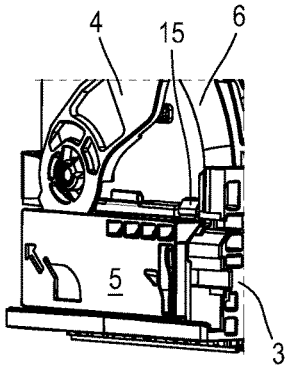
Figure 4C:
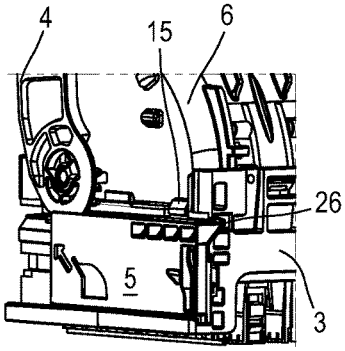

When the lever 4 is pivoted from its pre-coupling position towards its locked position, each slide 5 is brought by a system of gearing from its initial position depicted in FIG. 4A as far as its final position depicted in FIG. 4C by passing through an intermediate position depicted in FIG. 4B.

In the initial position of the slides 5, the cable guide cover 6 may be disassembled from the housing 3 by releasing the hook 20 from the notch 21 and by disengaging the beam from the edge 18. In contrast, in the final position of the slides 5, the latter cover the fixing feet 15 and their upper rib 26 is engaged in the groove 16 of one of the fixing feet 15.

Figure 5:
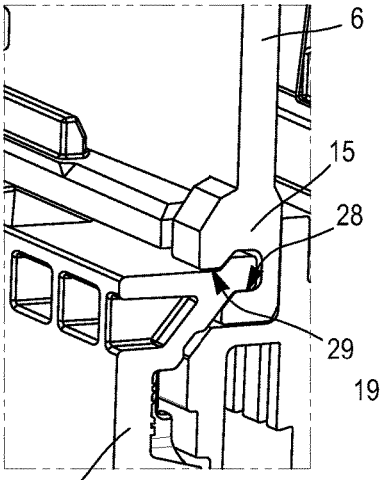
FIG. 5 corresponds to a detail depicted in section in FIG. 4C.
Figure 6:
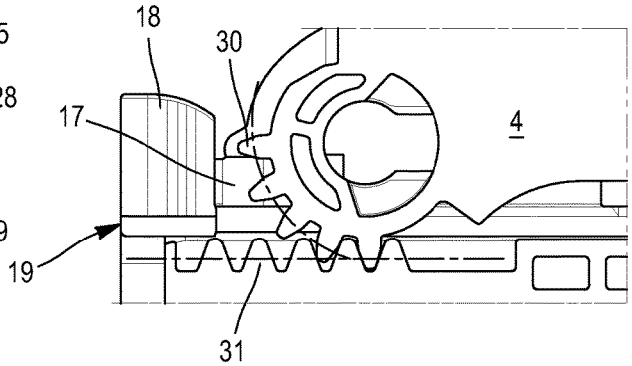
FIG. 6 corresponds to a detail of the system of engagement of the connector depicted in the preceding figures.

As depicted in a more detailed manner in FIG. 5, each of the fixing feet 15 includes a lower ramp 28 cooperating with a slide 5 when the latter is in the final position. The lower ramp 28 draws the slide 5 towards the cable guide cover 6. Conversely, each of the fixing feet 15 includes an upper ramp 29 cooperating with a slide 5 when the latter is in the final position. The upper ramp 29 draws the cable guide cover 6 towards the housing 3 when the slide 5 is in the final position. The lower ramps 28 and the upper ramps 29 assist the maintenance of the slides 5 by the ribs 26, 27 and grooves 24, 25 and guide the slides 5 in a better-adapted manner in order to achieve a more accurate position of the slides 5 in relation to the cable guide cover 6 and to the teeth 30 of the lever 4. As depicted in FIG. 6, this results in gear tracks (indicated as dashed lines) respectively on the teeth 30 of the lever 4 and on the rack 31 which are combined in the course of the rotation of the lever 4. Given that the cable guide cover 6 is maintained securely and accurately on its rear portion 12 thanks to the means for anchoring 17 that is maintained in the edge 18 (possibly inserted and wedged one in the other in the course of the positioning with a tilting movement of the cable guide cover 6, as illustrated by FIGS. 3A and 3B) and that the fixing feet 15 prevent the front portion 11 of the cable guide cover 6 from deviating from the slides 5, the position of the teeth 30 on the rack 31 may be defined and maintained in a precise manner.

It may also be noted in this figure that the rocking movement of the cable guide cover 6 when returning the front portion 11 of the cable guide cover 6 towards the housing 3 while the slides 5 are in the initial position (as illustrated in FIGS. 3A and 3B) is advantageous in order to be able to bring the teeth 30 into engagement with the rack 31 of each slide 5.

It may also be noted in the figures that the driving teeth 30 on each slide 5 interact with a rack 31 in the area of a portion of the connector situated towards the rear face 19 in relation to the fixing feet 15 which tends to be situated further towards the front. Thus, by reducing the free play in the area of the articulation of the cable guide cover 6 in the area of the means for anchoring 17 and by returning the cable guide cover 6 and each slide 5 one towards the other towards the front thanks to the fixing feet 15 it is possible to achieve even more accuracy in the relative position of the teeth 30 in relation to the rack 31.

While this invention has been described in terms of the preferred embodiments thereof, it is not intended to be so limited, but rather only to the extent set forth in the claims that follow. Moreover, the use of the terms first, second, primary secondary, etc. does not denote any order of importance, but rather the terms first, second, etc. are used to distinguish one element from another. Furthermore, the use of the terms a, an, etc. do not denote a limitation of quantity, but rather denote the presence of at least one of the referenced items.

We claim:

1. A connector, comprising:

a housing;

a lever;

a slide; and a cable guide cover, wherein the lever is rotatably mounted on the cable guide cover about an axis of rotation and is moveable between a pre-coupling position and a locking position, wherein the slide is movably mounted on the housing and is driven via the lever in translation in a direction that is perpendicular to the axis of rotation of the lever between the pre-coupling position of the lever and the locking position of the lever, and wherein the slide comprises means for restraining the cable guide cover, said means being displaced together with the slide and movable into engagement with the cable guide cover in a course of rotation of the lever.

2. The connector according to claim 1, wherein the cable guide cover comprises a front portion and a rear portion, said front portion having a fixing foot that is configured to disengage from the means for restraining the slide when the slide is in an initial position and configured to cooperate with the means for restraining the slide when the slide is in a final position and wherein the rear portion has a means for anchoring the cable guide cover on the housing.

3. The connector according to claim 2, wherein the cable guide cover comprises an opening situated in the rear portion for passage of a cable that is electrically connected to a contact mounted in the housing.

4. The connector according to claim 2, wherein the means for anchoring are caused to engage with the housing in the course of positioning the cable guide cover on the housing by raising the front portion in relation to the housing before returning the front portion towards the housing and placing the fixing foot in a zone of the housing that is covered by the slide when the slide is in the final position.

5. The connector according to claim 4, wherein the lever comprises teeth for driving the slide engage a rack of the slide when the front portion of the cable guide cover is returned towards the housing and when the slide is in the initial position.

6. The connector according to claim 5, wherein the teeth for driving the slide interact with the rack of the slide in a portion of the connector situated towards the rear portion in relation to the fixing foot.

7. The connector according to claim 2, wherein the fixing foot comprises a ramp cooperating with the slide when the slide is in the final position and the fixing foot draws the cable guide cover towards the housing when the slide is in the final position.

8. The connector according to claim 2, wherein the means for restraining of the cable guide cover comprise a rib that is integrally formed with the slide and is engaged in a groove of the cable guide cover when the slide is in the final position.

9. A connection assembly comprising the connector according to claim 2 and a counter-connector, wherein the counter-connector is configured to be coupled to the connector when the lever is in the pre-coupling position, wherein the connector and the counter-connector are locked together in the locking position, and wherein the slide cooperates with the counter-connector in the course of the slides translation between the initial position and the final position in order to couple the counter-connector to the connector and contributes to maintaining the cable guide cover on the housing in the final position.

* * * * *